US008998035B2

(12) United States Patent
Ford

(10) Patent No.: US 8,998,035 B2
(45) Date of Patent: Apr. 7, 2015

(54) LIQUID BEVERAGE CONCENTRATE DISPENSING SYSTEM

(71) Applicant: Bunn-O-Matic Corporation, Springfield, IL (US)

(72) Inventor: David F. Ford, Springfield, IL (US)

(73) Assignee: Bunn-O-Matic Corporation, Springfield, IL (US)

( * ) Notice: Subject to any disclaimer, the term of this patent is extended or adjusted under 35 U.S.C. 154(b) by 0 days.

(21) Appl. No.: 13/775,488

(22) Filed: Feb. 25, 2013

(65) Prior Publication Data

US 2013/0233887 A1 Sep. 12, 2013

Related U.S. Application Data

(60) Provisional application No. 61/602,685, filed on Feb. 24, 2012.

(51) Int. Cl.

| | |
|---|---|
| ***B67D 7/74*** | (2010.01) |
| ***B67D 7/16*** | (2010.01) |
| ***B67D 1/00*** | (2006.01) |
| ***B67D 1/08*** | (2006.01) |
| ***B67D 1/12*** | (2006.01) |

(52) U.S. Cl.

CPC ..... *B67D 7/16* (2013.01); *B67D 1/0039* (2013.01); *B67D 1/0888* (2013.01); *B67D 1/1231* (2013.01)

(58) Field of Classification Search

CPC ... F04B 43/1253; F04B 43/1256; B67D 7/16; B67D 1/1231

USPC ..... 222/63, 129.1, 214, 129.3, 129.4, 55, 222/57, 1

See application file for complete search history.

(56) References Cited

U.S. PATENT DOCUMENTS

| | | | | |
|---|---|---|---|---|
| 5,332,123 | A * | 7/1994 | Farber et al. | 222/129.4 |
| 5,875,930 | A * | 3/1999 | Nakajima et al. | 222/129.1 |
| 6,393,338 | B1 * | 5/2002 | Kemnitz | 700/231 |
| 7,740,152 | B2 * | 6/2010 | Hughes et al. | 222/129.1 |
| 2009/0020553 | A1 * | 1/2009 | Litterst et al. | 222/1 |

* cited by examiner

*Primary Examiner* — Daniel R Shearer

(74) *Attorney, Agent, or Firm* — Barnes & Thornburg, LLP

(57) ABSTRACT

A system, method, and apparatus are disclosed for controllably dispensing a liquid beverage concentrate for use in dispensing a beverage. The beverage may contain liquid beverage concentrate in combination with a liquid dilution ingredient such as water and may also include one or more additional ingredients. This system, method, and apparatus provides more precise control of the quantity of beverage concentrate dispensed by operating a pump used to dispense the concentrate based on the number of pulses of concentrate dispensed. A calibration is made to determine the measure of concentrate in each pulse. This volume per pulse is recorded and stored in a controller to controllably dispense a precise volume for a specific type of concentrate based on a predetermined recipe retained in the controller for each drink, type, and volume of the finished beverage.

13 Claims, 2 Drawing Sheets

LIQUID BEVERAGE CONCENTRATE DISPENSING SYSTEM

CROSS REFERENCE TO RELATED APPLICATIONS

This application claims the benefit of priority under 35 U.S.C. §119(e) to U.S. Provisional Patent Application No. 61/602,685, filed Feb. 24, 2012. The disclosure set forth in the referenced application is incorporated herein by reference in its entirety, including all information as originally submitted to the United States Patent and Trademark Office.

BACKGROUND

A system, method, and apparatus are disclosed for controllably dispensing a liquid beverage concentrate for use in dispensing a beverage. The beverage may contain liquid beverage concentrate in combination with a liquid dilution ingredient such as water and may also include one or more additional ingredients. This system, method, and apparatus provides more precise control of the quantity of beverage concentrate dispensed by operating a pump used to dispense the concentrate based on the number of pulses of concentrate dispensed. A calibration is made to determine the measure of concentrate in each pulse. This volume per pulse is recorded and stored in a controller to controllably dispense a precise volume for a specific type of concentrate based on a predetermined recipe retained in the controller for each drink, type, and volume of the finished beverage.

By way of background, a variety of liquid beverage concentrate dispensing systems have been developed. Such beverage dispensing systems may include a concentrate dispenser which dispenses a predetermined dose or volume of liquid coffee concentrate for combination with water. One way of dispensing a predetermined volume of liquid coffee concentrate is to operate a pump for a predetermined period of time. The specification of the pump determines the volume of substance dispensed per period of time. By operating the pump for a predetermined period of time an estimated volume of concentrate can be dispensed. Similarly, a pump or control valve on a water dispensing line coupled to the dispensing apparatus can dispense a predetermined volume of water over a given period of time. The combination of a predetermined volume of coffee concentrate and a predetermined volume of dilution water over a defined dispense time can be calibrated to dispense different beverage sizes. For example, a 12 ounce beverage will generally require twice as much water and beverage concentrate as a 6 ounce beverage.

While a time-based volume dispensing process has been useful, it would be more useful to improve the reliability and control of the volume of liquid concentrate dispensed. One of the issues that arise is with the dispensing of liquid concentrate is that the volume of concentrate dispensed may be relatively small. As a result, the pump is only operated for a very short period of time.

While a relatively short pump operating time can be manageable in some circumstances, the use of higher ratio liquid concentrate can exacerbate any tolerance issues associated with time-based concentrate dispensing. For example, as the ratio of the liquid concentrate increases the viscosity generally decreases. In other words, the liquid concentrate is thicker and likely more difficult to pump. The increased thickness of liquid concentrate can effect the operation of the pump and as a result a predetermined volume of liquid concentrate might not be dispensed within the period of time. Further, the high ratio liquid concentrate might not be as responsive when the pump is started. In other words, there might be a delay or lag in the flow of the higher viscosity liquid and as result the expected time-based predetermined volume might be less than expected or "shorted".

The potential issues might result in some degree of unpredictability or inconsistency in the dispensing of liquid concentrate. These issues might be exacerbated if one or more additional flavor ingredients are used with the liquid coffee concentrate. As an example, if a beverage recipe calls for a combination of liquid coffee concentrate, water, and one or more other flavor ingredients such as chocolate, the ratio of the liquid coffee concentrate to the finished beverage might be relatively small. Decreasing the volume of liquid coffee concentrate used in the beverage recipe of a specialty beverage exacerbates the issues identified above. Depending on the beverage market, these issues are further complicated if a smaller serving size is desired. In this regard, while many markets may prefer a 12 ounce or 16 ounce beverage, markets or recipes which produce a smaller finished beverage volume, such as 6 ounces, requires even less liquid coffee concentrate.

Another potential issue associated with time-based liquid coffee concentrate dispensing is the issue of an initial static load on the dispensing pump. The initial static load requires some period of "ramp up" time. In the shorter dispense times noted above due either to the decreased finish beverage size or the decreased volume of liquid coffee concentrate used in the finished beverage, there is even less time for the ramp-up period. While some beverage dispensing systems have attempted to resolve this by adjusting the voltage to the pump, the relatively short dispense times provide little time for the adjustment. One attempt to overcome this problem has been to use a smaller internal diameter pump tubing. In this regard, the pump speed can be increased thereby pumping a volume of liquid coffee concentrate to the smaller internal diameter tubing within a given period of time. However, this has not been a complete solution. Generally, the pump speeds are relatively slow and may often result in unreliable pump starts were which results in equipment "faults".

This background information provides some information believed by the applicant to be of possible relevance to the present disclosure. No admission is intended, nor should such admission be inferred or construed, that any of the preceding information constitutes prior art against the present invention. Other aims, objects, advantages and features of the invention will become more apparent upon reading of the following non-restrictive description of specific embodiments thereof, given by way of example only with reference to the accompanying drawings.

BRIEF DESCRIPTION OF THE DRAWINGS

The present disclosure will be described hereafter with reference to the attached drawings which are given as a non-limiting example only, in which.

Figure 1:
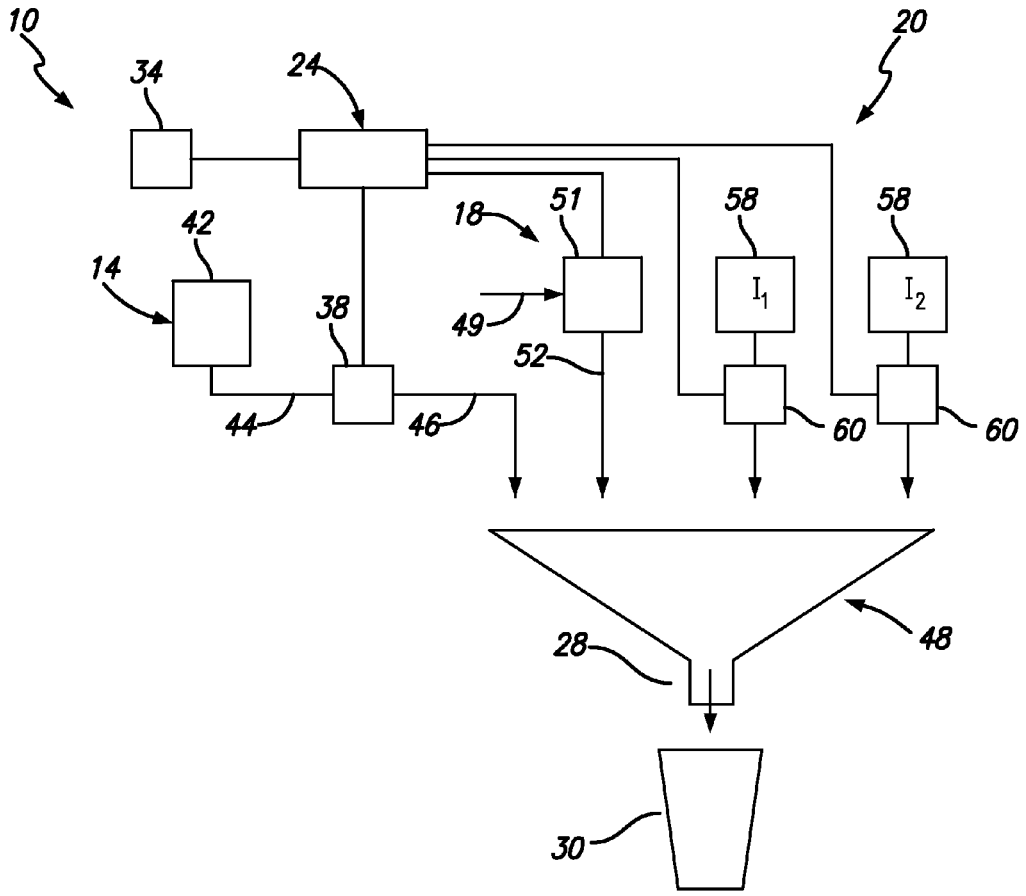
FIG. 1 is a general schematic block diagram showing the general configuration of a liquid beverage dispensing system combining liquid coffee concentrate dispensed by a controllable pump with water, additionally, one or more ingredients can be dispensed with the liquid coffee concentrate and water to produce a specialty beverage.

The exemplification set out herein illustrates embodiments of the disclosure that are not to be construed as limiting the scope of the disclosure in any manner. Additional features of the present disclosure will become apparent to those skilled in the art upon consideration of the following detailed description of illustrative embodiments exemplifying the best mode of carrying out the disclosure as presently perceived.

DETAILED DESCRIPTION

While the present disclosure may be susceptible to embodiment in different forms, there is shown in the drawings, and herein will be described in detail, embodiments with the understanding that the present description is to be considered an exemplification of the principles of the disclosure. The disclosure is not limited in its application to the details of structure, function, construction, or the arrangement of components set forth in the following description or illustrated in the drawings. The disclosure is capable of other embodiments and of being practiced or of being carried out in various ways. Also, it is to be understood that the phraseology and terminology used herein is for the purpose of description and should not be regarded as limiting. The use of various phrases and terms is meant to encompass the items or functions identified and equivalents thereof as well as additional items or functions. Unless limited otherwise, various phrases, terms, and variations thereof herein are used broadly and encompass all variations of such phrases and terms. Furthermore, and as described in subsequent paragraphs, the specific configurations illustrated in the drawings are intended to exemplify embodiments of the disclosure. However, other alternative structures, functions, and configurations are possible which are considered to be within the teachings of the present disclosure. Furthermore, unless otherwise indicated, the term "or" is to be considered inclusive.

With reference to FIG. 1, a general diagrammatic illustration of a beverage dispenser 10 is provided. The beverage dispenser 10 includes a liquid concentrate dispensing portion 14, a water dispensing portion 18, and one or more additional ingredient dispensing portions 20. Each of the portions 14, 18, 20 is coupled to a controller 24. The controller 24 controllably operates each of the portions to dispense a predetermined quantity of that ingredient based on a predetermined recipe to achieve a predetermined finished beverage satisfying the recipe. The beverage ingredients are dispensed into a funnel, collection tube, mixing chamber, or other device to result in the bringing together or combination and dispensing of the ingredients through a nozzle 28 into a serving container or cup 30.

The dilution ingredient is described in the present disclosure as being water. However, it should be appreciated that a variety of diluting ingredients could be used such as milk, juice, carbonated water, tea, coffee, as well as, other ingredients. Generally, the diluting ingredient will be in the form of a liquid although various viscosities of liquid are considered to be included in the present description.

Similarly, while the beverage ingredient described herein is referred to as "liquid coffee concentrate" for the convenience of description, this term should be broadly interpreted to include coffee, tea, juice concentrates, dairy based ingredients, or any other type of flavorings in any form now know or hereafter developed including but not limited to syrups, gel, crystals, powder, and any other food ingredient which can be used in the present system. Furthermore, the other ingredients may be in any variety of forms now know or hereafter developed including but not limited to liquid, gel, powder, frozen, freeze-dried, or any other form of ingredient which might be used in a beverage dispensing process.

In the general use of the beverage dispenser, a user operates a control panel 34 to activate the beverage dispenser or to select a particular resultant beverage or "drink". The control panel 34 is coupled to the controller 24. Once the drink has been selected, the controller 24 controllably operates the various portions of the dispenser. For a coffee-based beverage, the controller operates a pump 38 associated with the concentrate dispensing portion 14 to withdraw or otherwise controllably dispense the liquid concentrate from a concentrate reservoir 42. Concentrate passes through the line 44 under influence of the operation of pump 38 and is dispensed through an outlet line 46 to the mixing chamber 48. The reservoir may be in the form of a refillable reservoir or a prepackage volume of concentrate such as a can or bag-in-box container which is coupled to the line 44.

The controller 24 also operates the water delivery system or portion 18 to dispense a predetermined volume of water in relation to the beverage selected by the user at the control panel 34. Water is dispensed from water inlet line 49 by controlling the valve 51 to controllably dispense water through water outlet line 52 for mixing with the concentrate before dispensing through the nozzle 28 to the cup 30. The control valve 51 is coupled to the controller 24. A variety of techniques can be used for dispensing the water which are generally known in the art. While it is important to accurately control the volume of water dispensed, the water component makes up a larger portion of the finished beverage then the concentrate component and the viscosity of water is consistent and not subject to being reduced to a lower viscosity or being more concentrated. As such, it is important to accurately control the volume of concentrate since this provides the significant portion of flavoring and other characteristics in finished beverage. Additionally, a relatively small portion of coffee concentrate is dispensed and as such must be accurately dispensed in a repeatable manner.

While heated water might often be used in producing a finished coffee-based beverage, the water dispensed also may be ambient or chilled. The water dispensing portion 18 may provide a variety of controllable temperatures so that a user may select a heated beverage, a chilled beverage, or an ambient beverage. The present disclosure is not limited by the temperature of the resultant, finished the beverage and the disclosure is to be broadly interpreted to be inclusive of any temperature beverage.

Additional ingredients may be added by way of the ingredient portions 20. As noted above, these additional ingredients might include powders, gels, crystals, or other forms of ingredients. These additional ingredients could also be in a liquid concentrate form such as to add flavor, sweetening, and dairy-based ingredients such as milk or cream products either liquid or powdered. While the ingredient portions include an ingredient reservoir 58 and a dispensing component 60 these components can be understood to be similar to or identical to the concentrate reservoir 42 and the pump 38. However, it also may be that in it in the instance of a powdered ingredient an appropriate powder retaining hopper embodies the ingredient portion 58 and an appropriate auger or other incremental dispenser component embodies the dispensing component 60. As indicated in FIG. 1, the portions 14, 18, 20 are coupled to the controller 24 four controllably operating these portions to dispense quantities of ingredients in proportion to predetermined recipes.

Having described the overall structure and operation of the present system and apparatus, the method of controlling the liquid coffee concentrate 42 by means of operating the pumps 38 is described. As noted above in the background section, systems are known which dispense ingredients such as liquid coffee concentrate based on a combination of time dispensing and speed of operation of the pump 38. While this type of system can provide acceptable results in many situations, there may be problems with accuracy, consistency and repeatability. The present disclosure discloses a system, method and apparatus for controlling the pump based on speed and pulse counting. In other words, the number of pulses of the pump 38 can be counted by operation of the controller 24. If the dispenser 10 is calibrated to determine the volume of coffee concentrate dispensed in each pulse of the pump, a more accurate system and method of operation can be defined to provide enhanced control of the beverage dispenser.

By way of example, the controller 24 may include a microprocessor or other system for controlling operation of the dispenser 10. For a predetermined recipe, the volume of liquid coffee concentrate to be dispensed can be programmed in the controller 24. Programming of this recipe component can be programmed either during production of the dispenser 10 at the factory or by a user at the control panel 34. The user programming can be by way of the control panel though a manual operation or via an input device coupled to the controller such as an RFID reader, bar code reader, QR code reader, magnetic card reader, or any other know input device current available or hereafter developed. The dispenser 10 can be calibrated by measuring the volume of liquid coffee concentrate dispensed through the outlet line 42 during each pulse of the pump 38. The volume of coffee to be dispensed by the pump 40 predetermined recipe can be divided by the volume dispensed in each pulse count to determine how many pulse counts are required for a selected recipe.

The value of the defining the volume based on the pulse counts is that the accuracy of the volume dispensed for a predetermined recipe can be improved. In part, the improvement results from the ability to set the pump at a lower pumping speed but at a speed which helps assure and achieve a reliable pump start. In other words, a predetermined lower pump speed can be calculated for any particular pump and 88 combined liquid coffee concentrate substance based on the type of substance, viscosity, dispensing tube diameters and other characteristics. Once the minimum pump speed is determined, this setting can be stored in the controller 24. This allows the pump to operate at the minimum speed but also allows the pump to overcome the initial static load on the pump between operating cycles. As such, even if the pump is slow to start the total number of pulses of the pump can be counted to provide a reliable measure of the volume of concentrate dispensed for a predetermined number of pulses associated with a selected beverage recipe.

A variety of techniques may be used to count pulses of the pump. One such technique is to provide the pump with magnets on the output shaft. A Hall effect sensor is coupled with the pump shaft to detect the magnetic characteristics or "pulses". As an example, with four pole magnets carried on the output shaft, the Hall effect sensor can read four pulses for each rotation of the pump shaft.

As an additional benefit of using pulse counting to control the volume of liquid coffee concentrate dispensed, the number of pulses can be divided over the period of time during which the water or other ingredients are dispensed. This can be used to more evenly divide the liquid coffee concentrate throughout the entire dispensing cycle. As an example, if 12 pulses of liquid coffee concentrate are required during the dispensing of a 6 ounce beverage, for a relatively high ratio coffee concentrate, the controller 24 will operate the pump 38 to dispense approximately 2 pulses for each ounce of water dispensed. This avoids dispensing a large quantity of coffee concentrate at the beginning of the dispense cycle or at the end of the dispense cycle. More even distribution of the liquid coffee concentrate over the entire dispensing cycle helps to more thoroughly mix and integrate liquid coffee concentrate with the water and prevents striations or separation of the ingredients. This may be additionally useful when other ingredients are added to the finished beverage such that the additional ingredients can be dispensed over the entire dispensing cycle to likewise more thoroughly integrate all of the ingredients in the finished beverage.

Figure 2:
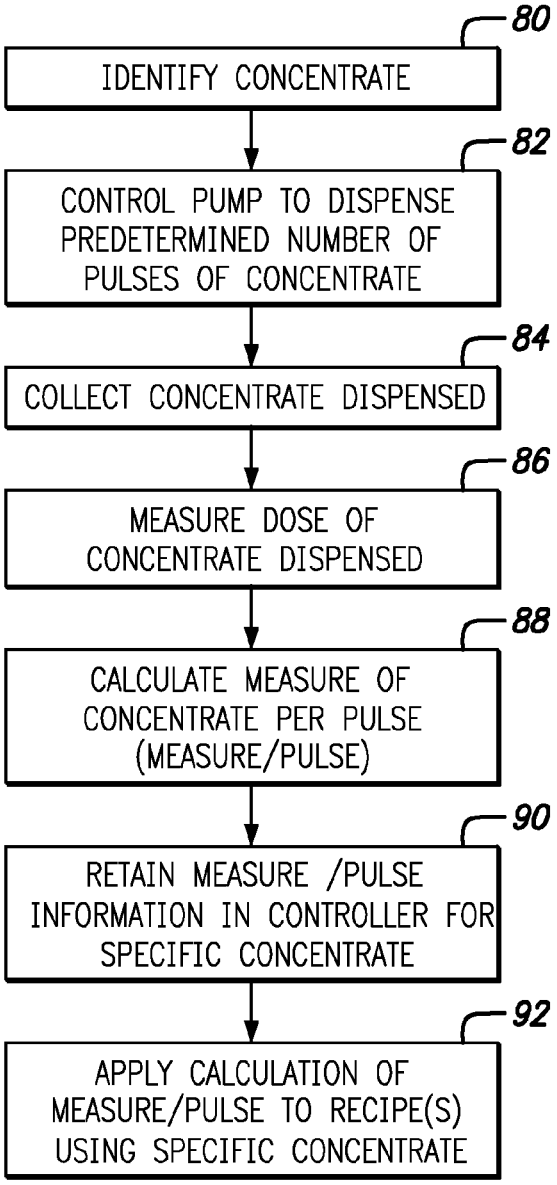
FIG. 2 is a general diagrammatic flowchart showing the steps and process used in the present disclosure.

With reference to FIG. 2, a general schematic flowchart is provided. The flowchart documents the general steps required for the present algorithm associated with the operation and control of the dispenser 10. In the first step (80) a specific concentrate is identified. The concentrate identifier can be selected so that a record may be made and retained at a separate storage location or on the controller 24 for use in establishing a lookup table or other reference point for the concentrate. The objective will be to provide a calculation associated with the characteristics related to the pumping of the specific concentrate so as to provide the calculation in the lookup table for use in beverage dispensing recipes.

Once the concentrate is identified, the next step (82) is to controllably operate the pump to dispense a predetermined number of pulses of concentrate. In the next step (84) the concentrate is collected during this dispensing cycle (without being diluted by water or having other ingredients added) so as to permit the measurement of the dispense quantity of concentrate. In the next step (86) the collected concentrate is measured by weighing or measuring the volume of the concentrate or any other acceptable standardized measurement technique appropriate for measuring the concentrate. In the next step (88) a calculation is made to determine the volume or weight per pulse. This calculation provides a tangible measure of the volume, weight or other quantity of concentrate dispensed per pulse. This is important since each pulse can provide a small accurate quantity of concentrate for accurate dispensing into a finished beverage.

In the next step (90) the calculation is added to a table in the controller 24 or a corresponding remote location. The calculated quantity per pulse is associated with the type or identity of the concentrate. This will facilitate programming the dispenser 10 for use with a variety of concentrates. In this regard, either a single concentrate can be used with the dispenser or the additional ingredients 58 but also be in the form of concentrates which can also be stored. While "additional" ingredients are referred to in the present disclosure, it should be understood that these ingredients might be "alternative" ingredients. For example, one form of concentrate 42 may be "regular" coffee concentrate. An alternative form of concentrate 58 might be in the form of "decaf" coffee concentrate. This alternative ingredient allows for expanding the beverage choices to include regular, decaf, and other specialty drinks created by adding additional ingredients.

Finally, the next step (92) is to apply the calculated measurement to the recipes. This can be in the form of merely dispensing beverages using the predetermined calibrations or by taste testing the recipes. If taste tests are executed, the system can be adjusted to add more or less coffee concentrate by adding or subtracting additional pulse counts. In this regard, the use of the pump speed and pulse counting to control the volume of concentrate dispensed can provide a highly accurate means of measuring.

While the enhanced control of the dispensing of concentrate into the finished beverage can provide enhanced flavor control and repeatability, the system can also provide improved ingredient control. The enhanced accuracy of using a speed and pulse counts system can actually reduce costs per beverage. Tighter accuracy control in dispensing of the concentrate, a much more expensive ingredient than water, can maintain the specific volume dispensed per beverage. In contrast, a system which might have less uniformity could dispense more beverage concentrate over multiple cycles thereby unnecessarily wasting concentrate. The system can also enhance the flavor control of the dispensed beverages. In this regard, more accurate dispensing of beverage concentrate prevents too much or too little concentrate from being added and mixed with the water. This helps ensure that the user will have a more consistent beverage experience, and if the recipe is tuned for the user preferences, this may enhance the repeat business of the users.

While the present disclosure describes various exemplary embodiments, the disclosure is not so limited. To the contrary, the disclosure is intended to cover various modifications, uses, adaptations, and equivalent arrangements based on the principles disclosed. Further, this application is intended to cover such departures from the present disclosure as come within at least the known or customary practice within the art to which it pertains. It is envisioned that those skilled in the art may devise various modifications and equivalent structures and functions without departing from the spirit and scope of the disclosure as recited in the following claims. The scope of the following claims is to be accorded the broadest interpretation so as to encompass all such modifications and equivalent structures and functions.

The invention claimed is:

1. A method of dispensing a beverage using at least a combination of beverage concentrate and a dilution ingredient, the method comprising the steps of identify a concentrate, pump a predetermined number of pulses of the identified concentrate, collect the predetermined number of pulses of the identified concentrate, measure the collected identified concentrate, determine the amount of identified concentrate dispensed per pulse, providing the amount of identified concentrate dispensed per pulse to a controller, providing a recipe for a beverage which prescribes an amount of the identified concentrate for combination with an amount of a dilution ingredient to make a beverage, making a beverage by dispensing the recipe amount of the identified concentrate by using the controller to pump the number of pulses needed to provide the recipe amount of the identified concentrate and by dispensing the recipe amount of a dilution ingredient, and determining a minimum pump speed for an identified concentrate so that repeating the step of collecting the predetermined number of pulses of the identified concentrate results in substantially the same measure of the collected identified concentrate.

2. The method of claim 1 wherein the step of making a beverage comprises pumping the predetermined number of pulses of identified concentrate at the minimum pump speed to provide a reliable measure of identified concentrate.

3. The method of claim 2 wherein the step of making a beverage comprises pumping the predetermined number of pulses of identified concentrate at the minimum pump speed so that the predetermined number of pulses is distributed substantially equally over the time of dispensing of the dilution ingredient.

4. The method of claim 1 wherein the measuring step comprises weighing the collected concentrate.

5. The method of claim 1 wherein the determining step comprises calculating to determine the volume of concentrate per pulse.

6. The method of claim 1 wherein the determining step comprises calculating to determine the weight of concentrate per pulse.

7. The method of claim 5 wherein the volume of concentrate per pulse resulting from the calculating step is added to a lookup table in the controller.

8. The method of claim 6 wherein the weight of concentrate per pulse resulting from the calculating step is added to a lookup table in the controller.

9. The method of claim 1 comprising identify another concentrate, pump a predetermined number of pulses of the another concentrate, collect the predetermined number of pulses of the another concentrate, measure the collected another concentrate, determine the amount of another concentrate dispensed per pulse, providing the amount of another concentrate dispensed per pulse to a controller, providing a recipe for a beverage which prescribes an amount of the another concentrate for combination with an amount of a dilution ingredient to make a beverage, making a beverage by dispensing the recipe amount of the another concentrate by using the controller to pump the number of pulses needed to provide the recipe amount of the another concentrate and by dispensing the recipe amount of a dilution ingredient, and wherein the number of pulses needed to provide the recipe amount of the another concentrate is different from the number of pulses needed to provide the recipe amount of the identified concentrate.

10. The method of claim 1 wherein the dilution ingredient is water.

11. An apparatus for dispensing a beverage using at least a combination of beverage concentrate and a dilution ingredient, the apparatus comprising means for identifying a concentrate, a controller, means for determining the amount of the identified concentrate dispensed per pulse and for providing the amount of the identified concentrate dispensed per pulse to the controller, a pump, means for making a beverage from a recipe prescribing an amount of the identified concentrate and an amount of a dilution ingredient to make a beverage by dispensing the recipe amount of the identified concentrate by using the controller to operate the pump to pump the number of pulses needed to provide the recipe amount of the identified concentrate and combine it with the recipe amount of the dilution ingredient, wherein the means for determining comprises means to pump, then collect and then measure a predetermined number of pulses of the identified concentrate, the pump is operable at a minimum pump speed for an identified concentrate so that repetition of the step of collecting the predetermined number of pulses of the identified concentrate results in substantially the same measure of the collected identified concentrate, and said minimum pump speed is stored in said controller.

12. The apparatus of claim 11 wherein controller is adapted to operate the pump for the number of pulses needed to provide the recipe amount of the identified concentrate at the minimum pump speed so that the number of pulses needed to provide the recipe amount of the identified concentrate is distributed substantially equally over the time of dispensing of the dilution ingredient.

13. The apparatus of claim 11 wherein the controller includes a lookup table with different concentrate identifiers.

* * * * *